US012758074B2

(12) United States Patent
Fedrigon et al.

(10) Patent No.: US 12,758,074 B2
(45) Date of Patent: Oct. 13, 2026

(54) SCRUBBER WITH NON-CIRCULAR BRUSH HEAD

(71) Applicant: TECHTRONIC CORDLESS GP, Anderson, SC (US)

(72) Inventors: Jeremy Fedrigon, Greenville, SC (US); Thomas Evatt, Six Mile, SC (US); Keith Lombardi, Easley, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 506 days.

(21) Appl. No.: 17/825,893

(22) Filed: May 26, 2022

(65) Prior Publication Data

US 2022/0378270 A1 Dec. 1, 2022

Related U.S. Application Data

(60) Provisional application No. 63/194,439, filed on May 28, 2021.

(51) Int. Cl.
*A47L 11/40* (2006.01)
*A47L 11/162* (2006.01)

(52) U.S. Cl.
CPC ..... *A47L 11/4036* (2013.01); *A47L 11/162* (2013.01)

(58) Field of Classification Search
CPC ..... A47L 11/16; A47L 11/164; A47L 11/283; A47L 11/293; A47L 11/4036; A47L 11/4038; A46B 13/02; A46B 13/008; A46B 7/08; A46B 5/00; A46D 1/00
USPC ..... 15/28, 50.1, 56, 57, 87, 180, 230.14, 15/230.18
See application file for complete search history.

(56) References Cited

U.S. PATENT DOCUMENTS

| | | | | |
|---|---|---|---|---|
| 1,870,232 A | | 8/1932 | Brim | |
| 2,650,381 A | | 9/1953 | Fleming | |
| 2,682,675 A | * | 7/1954 | Prucha | A46B 13/06 15/180 |
| 2,999,258 A | | 9/1961 | Berberian | |

(Continued)

FOREIGN PATENT DOCUMENTS

| | | |
|---|---|---|
| CH | 399675 A | 9/1965 |
| CN | 2073254 U | 3/1991 |

(Continued)

OTHER PUBLICATIONS

Extended European Search Report for Application No. 22175342.9 dated Feb. 24, 2023 (12 pages).

(Continued)

*Primary Examiner* — Brian D Keller
*Assistant Examiner* — Aaron R Mcconnell
(74) *Attorney, Agent, or Firm* — Michael Best & Friedrich LLP

(57) ABSTRACT

A brush head including a central portion centered respective to a rotation axis, an attachment feature configured to secure the brush head for rotation about the rotation axis, and a plurality of lobes. The plurality of lobes extend radially outwardly from the central portion and the rotation axis. At least one lobe extends along a curvilinear path, the curvilinear path extending through the central portion. The lobe has varying widths along the curvilinear path, the varying widths being perpendicular to the curvilinear path.

18 Claims, 19 Drawing Sheets

(56) References Cited

U.S. PATENT DOCUMENTS

| | | | | |
|---|---|---|---|---|
| 3,011,189 | A | 12/1961 | Hulsh | |
| 3,011,191 | A | 12/1961 | Hulsh | |
| 3,115,654 | A | 12/1963 | Zimmerman | |
| 3,243,832 | A | 4/1966 | Allen et al. | |
| 3,518,709 | A | 7/1970 | Zemke et al. | |
| 3,813,726 | A | 6/1974 | Kowalewski | |
| 4,137,590 | A | 2/1979 | Brown | |
| 4,183,112 | A | 1/1980 | Brown et al. | |
| 4,219,898 | A | 9/1980 | Presby | |
| 4,231,132 | A * | 11/1980 | Watanabe | B08B 9/087 15/56 |
| 4,236,269 | A | 12/1980 | Block | |
| 4,409,702 | A | 10/1983 | Brown | |
| 4,598,440 | A | 7/1986 | Wilson | |
| 4,701,970 | A | 10/1987 | Wilson | |
| 4,739,534 | A | 4/1988 | Wilson | |
| 4,771,498 | A | 9/1988 | Torta | |
| 4,998,314 | A | 3/1991 | Borofsky | |
| 5,438,728 | A | 8/1995 | Kubes et al. | |
| D463,965 | S | 10/2002 | Lee et al. | |
| D466,912 | S | 12/2002 | Lee | |
| D477,207 | S | 7/2003 | Kim et al. | |
| D515,818 | S | 2/2006 | Groblebe et al. | |
| 7,203,987 | B2 | 4/2007 | Kuivikko et al. | |
| 7,802,339 | B2 | 9/2010 | Kuivikko et al. | |
| D668,912 | S | 10/2012 | Haggerty et al. | |
| 8,291,541 | B2 | 10/2012 | Delaere et al. | |
| 8,621,703 | B2 | 1/2014 | Delaere et al. | |
| D745,355 | S | 12/2015 | Butler | |
| D807,718 | S | 1/2018 | Matsubara et al. | |
| D851,407 | S | 6/2019 | Brown et al. | |
| 10,632,511 | B2 * | 4/2020 | Patterson | A46B 7/042 |
| D899,213 | S | 10/2020 | Lundbaeck et al. | |
| 11,006,803 | B2 | 5/2021 | Blum | |
| D932,778 | S | 10/2021 | Jing | |
| D959,151 | S | 8/2022 | Lee et al. | |
| 11,672,327 | B1 * | 6/2023 | Mongan | A47K 7/04 15/21.1 |
| D1,027,457 | S | 5/2024 | Pan | |
| 2011/0083289 | A1 * | 4/2011 | Heatley-Adams | A61C 17/222 15/22.2 |
| 2012/0054981 | A1 | 3/2012 | Cantrell | |
| 2013/0276827 | A1 | 10/2013 | Delaere et al. | |
| 2018/0242722 | A1 * | 8/2018 | Patterson | A46B 7/04 |
| 2018/0338655 | A1 | 11/2018 | Schregardus et al. | |
| 2021/0000248 | A1 | 1/2021 | Erickson et al. | |
| 2024/0284824 | A1 | 8/2024 | Hoffman et al. | |

FOREIGN PATENT DOCUMENTS

| | | | | |
|---|---|---|---|---|
| CN | 2660984 | Y | 12/2004 | |
| CN | 2660985 | Y | 12/2004 | |
| CN | 2722712 | Y | 9/2005 | |
| CN | 2858763 | Y | 1/2007 | |
| CN | 103086011 | A | 5/2013 | |
| CN | 203073532 | U | 7/2013 | |
| CN | 204995380 | U | 1/2016 | |
| CN | 207136817 | U | 3/2018 | |
| CN | 110353395 | A | 10/2019 | |
| CN | 306708311 | | 7/2021 | |
| CN | 307635415 | | 11/2022 | |
| CN | 307716170 | | 12/2022 | |
| CN | 307734937 | | 12/2022 | |
| CN | 307815241 | | 1/2023 | |
| CN | 308024105 | | 5/2023 | |
| CN | 308882781 | | 10/2024 | |
| DE | 1093273 | B | 11/1960 | |
| DE | 3146532 | A1 | 10/1982 | |
| DE | 29610023 | U1 | 10/1996 | |
| FR | 1332090 | A | 12/1963 | |
| GB | 381327 | A | 10/1932 | |
| GB | 484471 | A | 5/1938 | |
| GB | 734834 | A | 8/1955 | |
| GB | 786813 | A | 11/1957 | |
| GB | 982306 | | 2/1965 | |
| KR | 20100130740 | A | 12/2010 | |
| KR | 20110020608 | A * | 3/2011 | B08B 3/08 |
| KR | 20140003527 | U * | 6/2014 | A46B 9/04 |
| WO | 2004073476 | A1 | 9/2004 | |
| WO | 2020077963 | A1 | 4/2020 | |

OTHER PUBLICATIONS

Ryobi, "Ryobi Rakscrubm Medium Nylon Brush (Single)," <https://www.amazon.com/Ryobi-RAKSCRUBM-Medium-Nylon-Single/dp/B08Y5WXN6M/> web page visited Jun. 11, 2025 (7 pages).

Ryobi, "7 in. Vortex Soft Bristle Brush," <https://www.homedepot.com/p/RYOBI-7-in-VORTEX-Soft-Bristle-Brush-A95SRB7/324055319> web page visited Jun. 11, 2025 (7 pages).

Ryobi, "Medium Bristle Round Brush with Hex Shank Compatibility," <https://www.homedepot.com/p/RYOBI-Medium-Bristle-Round-Brush-with-Hex-Shank-Compatibility-A95RMB1/323974220> web page visited Jun. 11, 2025 (7 pages).

<Ryobi, "11 in. Vortex Soft Bristle Brush," <https://www.homedepot.com/p/RYOBI-11-in-VORTEX-Soft-Bristle-Brush-A95SRB11/323974242#overlay> web page visited Jun. 11, 2025 (7 pages).

* cited by examiner

SCRUBBER WITH NON-CIRCULAR BRUSH HEAD

CROSS-REFERENCE TO RELATED APPLICATION

This application claims priority to U.S. Provisional Patent Application No. 63/194,439, filed May 28, 2021, the entire contents of which are incorporated by reference herein.

TECHNICAL FIELD

The present disclosure relates to scrubbers, and more particularly to scrubbers with non-circular brush heads and the like.

BACKGROUND

In conventional scrubbers, circular shaped brush heads include bristles or brush pads which contact a work surface for scrubbing the work surface.

SUMMARY

In one independent aspect, a brush head includes a central portion centered respective to a rotation axis, an attachment feature configured to secure the brush head for rotation about the rotation axis, and a plurality of lobes. The plurality of lobes extend radially outwardly from the central portion and the rotation axis. At least one lobe extends along a curvilinear path, the curvilinear path extending through the central portion. The lobe has varying widths along the curvilinear path, the varying widths being perpendicular to the curvilinear path.

In another independent aspect, a brush head includes a central portion centered about a rotation axis, an attachment feature configured to secure the brush head for rotation about the rotation axis, a plurality of lobes, and an outer ring. The plurality of lobes extend radially outwardly from the central portion and the rotation axis. At least one lobe extends along a curvilinear path, the curvilinear path extending through the central portion. The outer ring is coupled to one or more of the plurality of lobes.

In another independent aspect, a brush head includes a central portion centered about a rotation axis, an attachment feature configured to secure the brush head for rotation about the rotation axis, and a plurality of lobes. The plurality of lobes extend radially outwardly from the central portion and the rotation axis. At least one of the plurality of lobes extends along a rectilinear path, the rectilinear path extending through the central portion. The rectilinear path has an inner segment and an outer segment angled relative to the inner segment. The one of the plurality of lobes has a proximal portion extending along the inner segment and a distal portion extending along the outer segment.

Other aspects of the disclosure will become apparent by consideration of the detailed description and accompanying drawings.

Before any aspects are explained in detail, it is to be understood that the invention is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Figure 1:
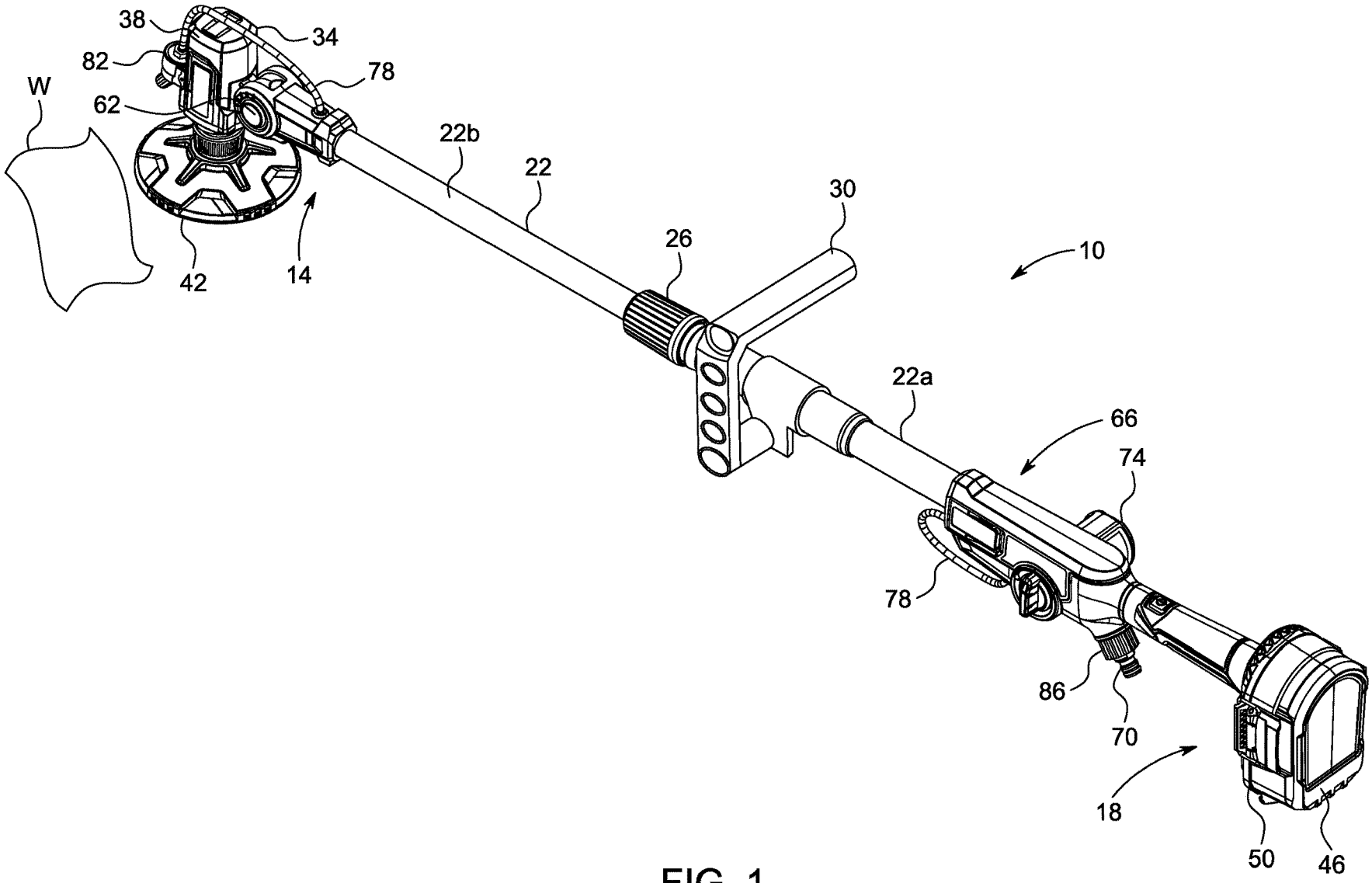
FIG. 1 is a perspective view of a scrubber.
Figure 2:
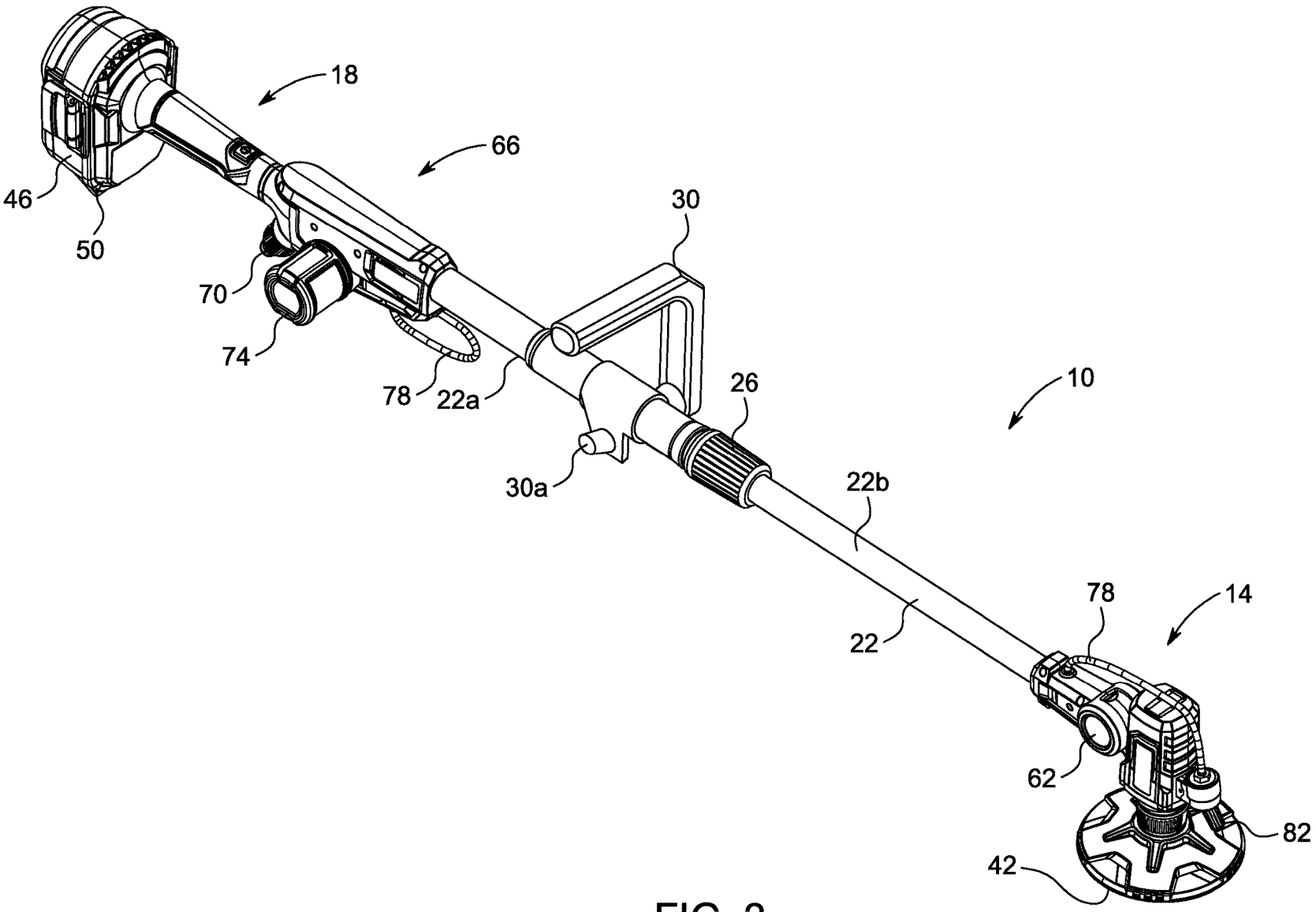
FIG. 2 is another perspective view of the scrubber of FIG. 1.
Figure 3:
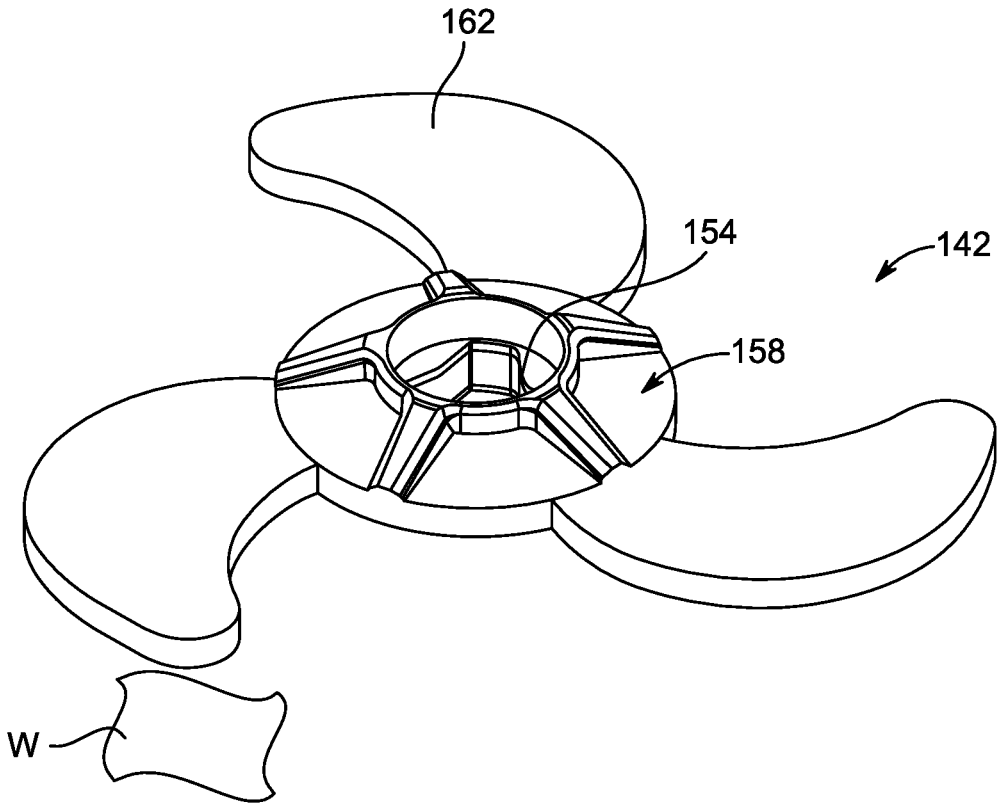
FIG. 3 is a perspective view of a brush head.
Figure 4:
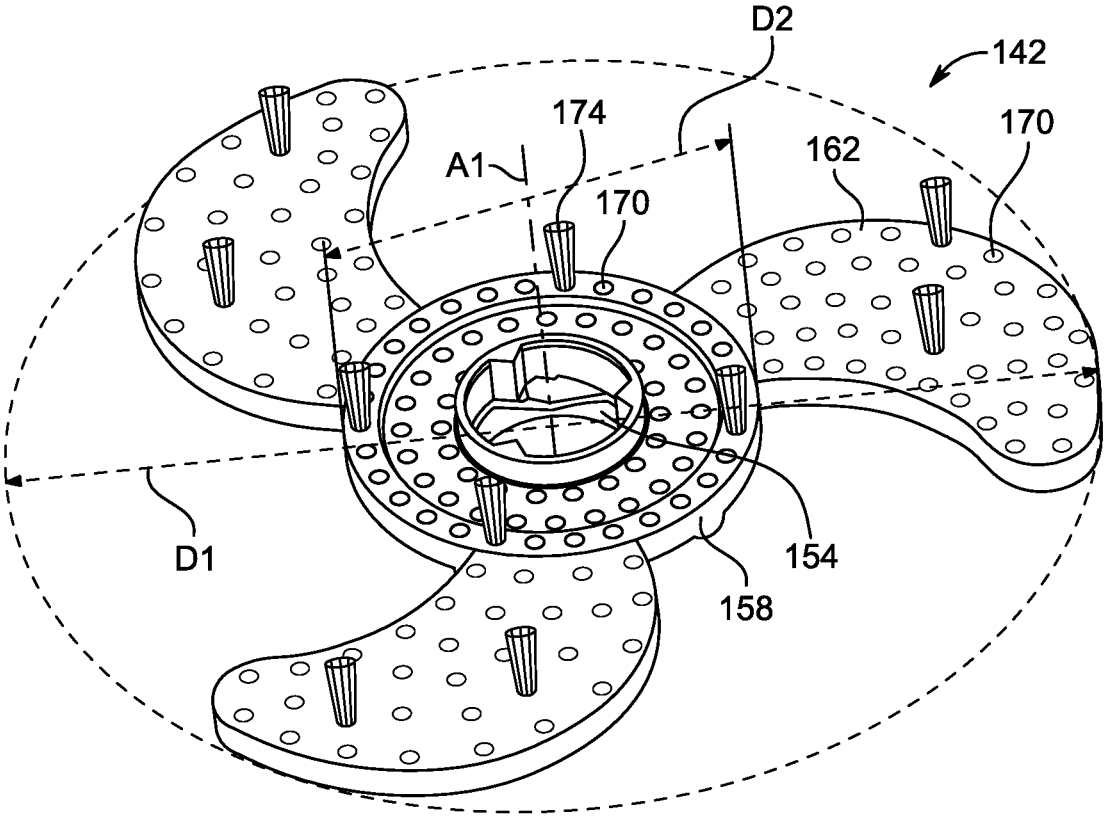
FIG. 4 is another perspective view of the brush head of FIG. 3.

FIGS. 1 and 2 illustrate an exemplary scrubber 10. The scrubber 10 includes a first end or scrubbing end 14 and a second end or base end 18. The scrubber 10 is a power scrubber 10. In some embodiments, a telescopic shaft 22 connects the scrubbing end 14 to the base end 18. The telescopic shaft 22 includes a first portion 22*a* and a second portion 22*b* which are telescopic relative to each other. A handle 30 surrounds the first portion 22*a* and is secured to the first portion 22*a* at a desired location between the base end 18 and the coupler 26 by a fastener 30*a*. In other embodiments, the scrubber 10 may be of another, for example, a hand-held form not including the telescopic shaft 22.

A scrubber head 34 is provided adjacent the scrubbing end 14. The scrubber head 34 houses a motor 38 therein. The motor 38 is coupled to a brush head 42 (i.e., a brush head 42) and a battery pack 46. The battery pack 46 engages a battery receptacle 50 adjacent the base end 18. A wire 54 passes through the telescopic shaft 22 to provide an electrical connection between the battery pack 46 and the motor 38. A button 58 is provided on the exterior of the base end 18 to permit a user to control flow of power from the battery pack 46 to the motor 38 and to adjust operation of the motor 38. As illustrated in FIGS. 1 and 2, the brush head 42 is generally circularly shaped. The brush head 42 is also opaque. Accordingly, the brush head 42 hides from view a workpiece W upon which the brush head 42 is configured to clean.

As shown in FIGS. 1 and 2, in the illustrated embodiment the scrubber head 34 is pivotable about a pivot joint 62. The pivot joint 62 is provided at an end of the second portion 22*b* opposite the coupler 26. The pivot joint 62 may lock the scrubber head 34 in a desired position relative to the telescopic shaft 22. In some embodiments, the scrubber 10 includes a mode selector assembly 66 operable to adjust operation of a fluid dispensing of the scrubber 10. The mode selector assembly 66 receives fluid from a fluid inlet nozzle 70 and a reservoir 74, and outlets fluid from either or both of the fluid inlet nozzle 70 and the reservoir 74 through a tube 78 and ultimately a dispensing nozzle 82. An actuator 86 is operable to adjust a position of the mode selector assembly 66 to selectively dispense or restrict fluid from the fluid inlet nozzle 70 and fluid from the reservoir 74. The dispensing nozzle 82 is located adjacent the brush head 42 and the first end or scrubbing end 14 of the scrubber 10.

FIGS. 3-6 illustrate a brush head 142 according to another embodiment. The brush head 142 is non-circular in shape. The brush head 142 includes a work end 146 and an opposite attachment end 150 (FIG. 5) opposing the work end 146 about the rotation axis A1. The brush head 142 includes an attachment feature 154 adjacent the attachment end 150. The attachment feature 154 is configured to quickly couple and decouple the brush head 142 from the motor 38. The brush head 142 is driven to rotate due to operation of the motor 38 about a rotation axis A1.

Figure 6:
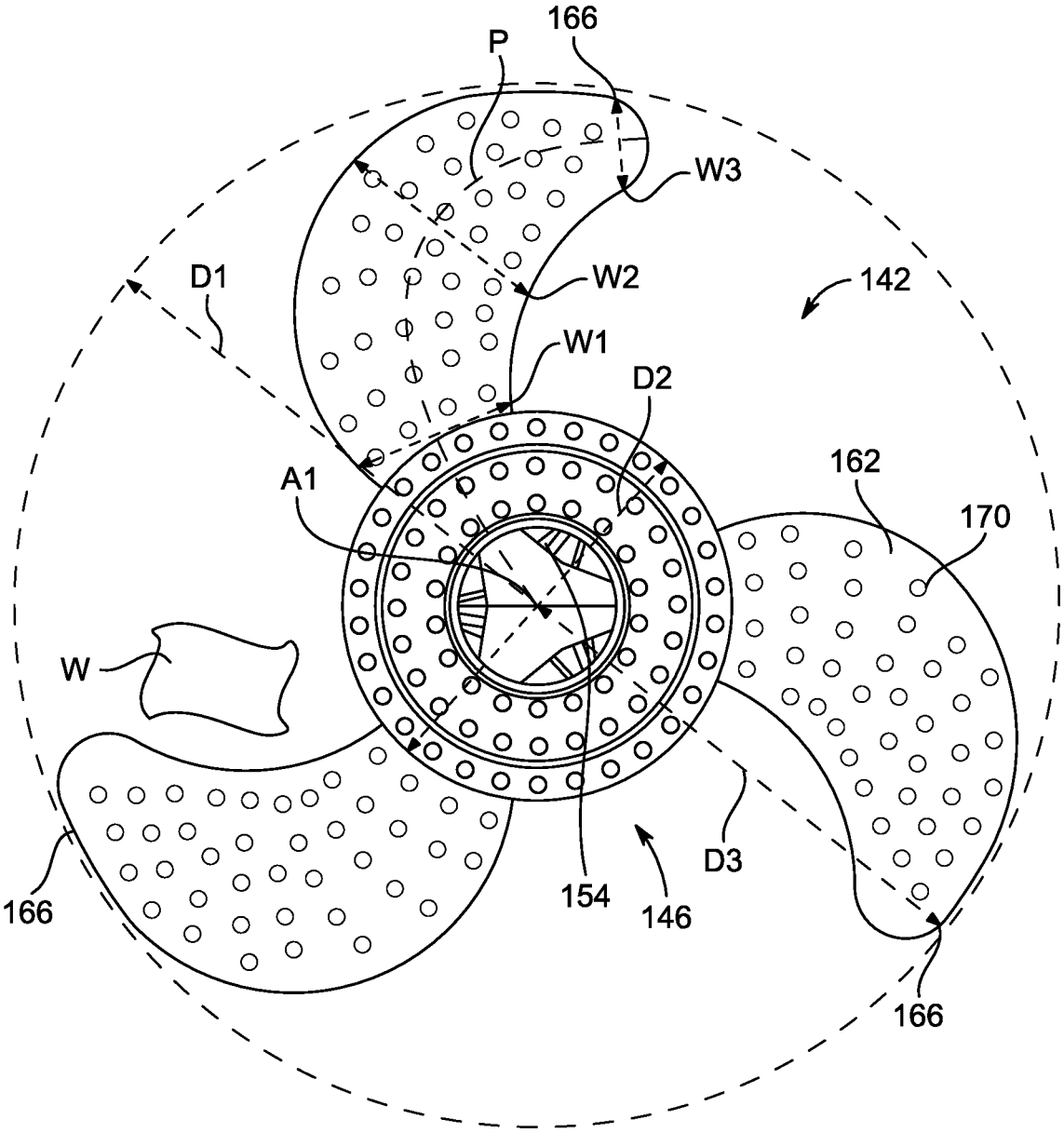
FIG. 6 is an end view of a work end of the brush head of FIG. 3.
Figure 7:
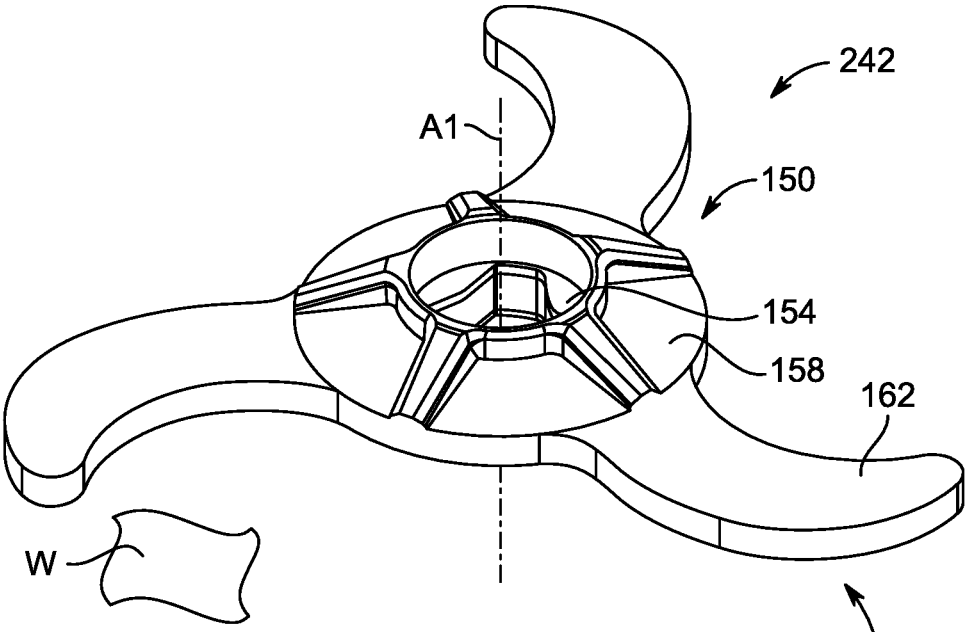
FIG. 7 is a perspective view of a brush head according to another embodiment.
Figure 8:
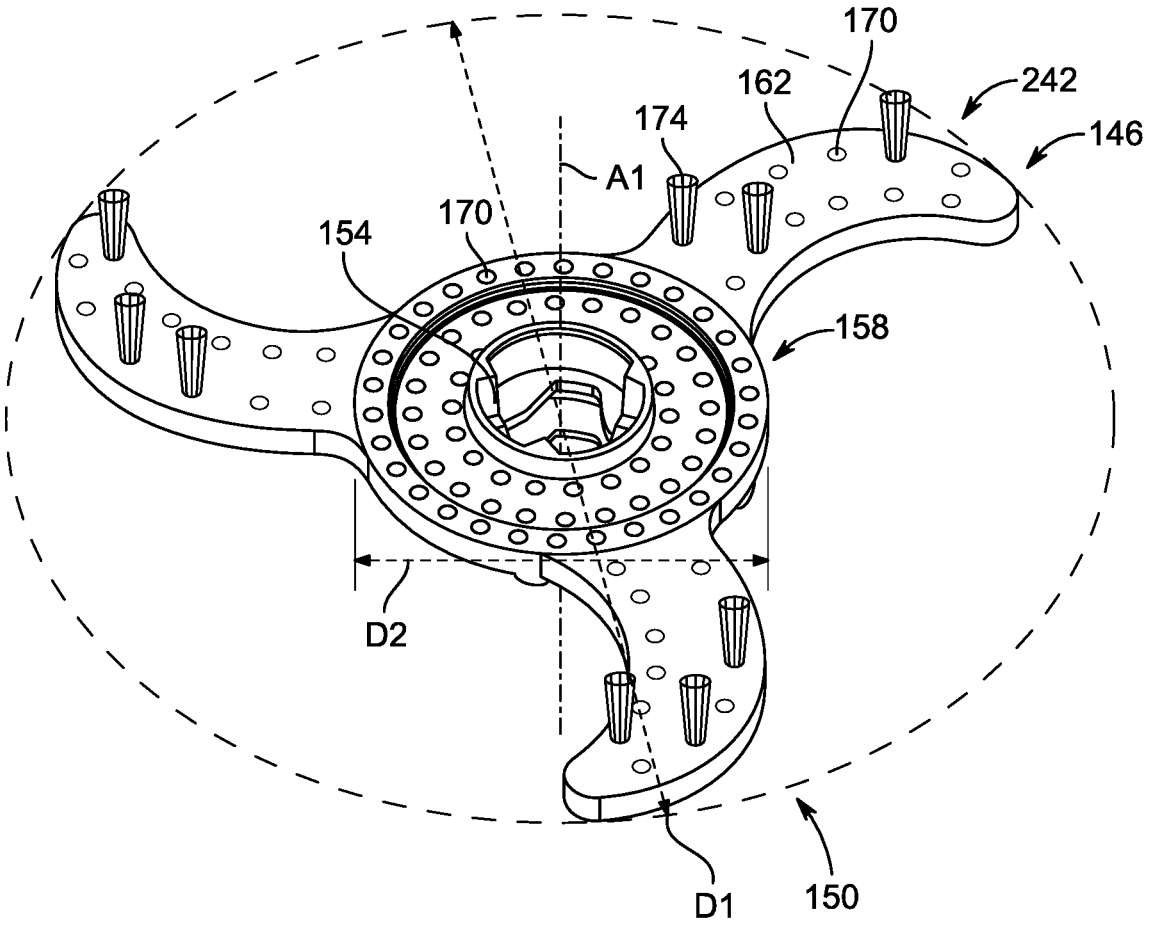
FIG. 8 is another perspective view of the brush head of FIG. 7.
Figure 9:
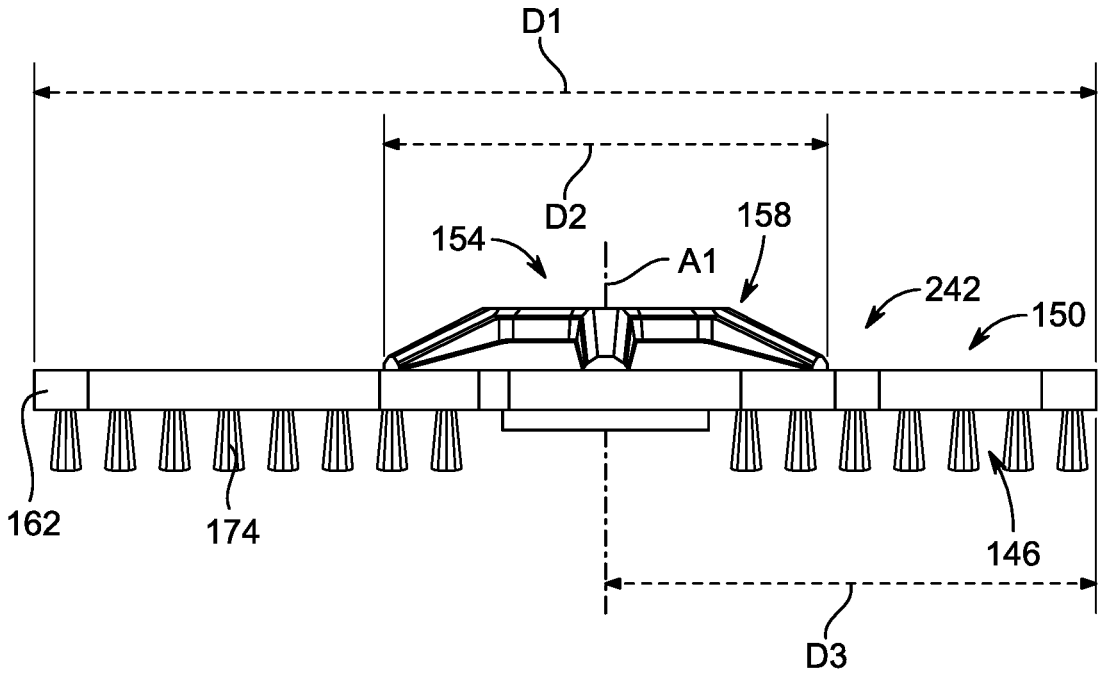
FIG. 9 is a side view of the brush head of FIG. 7.

The illustrated attachment feature 154 includes a generally triangular profile (FIG. 6). The triangular profile of the attachment feature 154 may include ramps that allow the attachment feature 154 to engage the scrubber head 34, and more specifically, the motor 38. In other embodiments, the brush head 142 may be coupled to the scrubber head 34 in another manner. For example, the attachment feature may include a hexagonal shaft for engaging the scrubber head to receive a torque output from the motor 38. Optionally, the attachment feature having a shaft (e.g., a hexagonal shaft, not shown) may be secured to the scrubber head 34 through a quick release coupler (not shown) including a socket which is translatable to cause a spring biased ball detent to lock or unlock the attachment feature. Other attachment features 154 and connection mechanisms between the attachment feature 154 and the motor 38 are possible.

The brush head 142 includes a central portion 158 and a plurality of radially outwardly extending lobes 162. The central portion 158 is generally circular in shape. However, as the lobes 162 extend radially outwardly from the central portion 158, the brush head 142 as a whole is non-circular (i.e., not circular) in shape. The lobes 162 are spaced about the rotation axis A1 such that as the user operates the brush head 142, the user may view the workpiece W acted upon by the brush head. In the illustrated embodiment, the lobes 162 are evenly circumferentially spaced about the rotation axis A1. In the illustrated embodiment, three lobes 162 are provided. Other numbers of lobes 162 are possible. In the illustrated embodiment, the central portion 158 is generally circular, and the rotation axis A1 is centered with respect to the central portion 158. Each of the lobes 162 extends to a respective distal point 166. The distal points 166 are disposed from the rotation axis A1 of the brush head 142. As a result, an effective diameter D1 (i.e., an outer diameter D1) of the brush head 142 includes the diameter D2 of the central portion 158 and is measured as twice the radial distance D3 between the rotation axis A1 and the distal points 166. As the lobes 162 do not take up the entirety of the space between the distal points 166 and the central portion 158, a user is capable of viewing the work surface between the central portion 158 and the distal points 166 at positions not obstructed from view by the lobes 162. The lobes 162 each are curvilinear extensions of the central portion 158 of the brush head 142. For example, the lobes 162 may extend outwardly from the central portion 158 in a fan shape or a helical shape.

Figure 5:
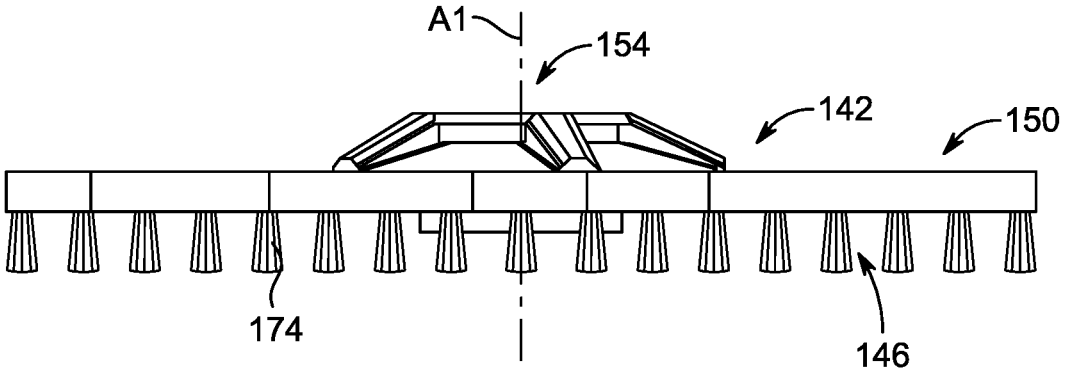
FIG. 5 is a side view of the brush head of FIG. 3.

As shown in FIGS. 5 and 6, the central portion 158 and optionally each of the lobes 162 include bristle receptacles 170 configured to hold bristles 174 therein. As shown in FIG. 5, when secured in the bristle receptacles 170, the bristles 174 project from the work end 146 of the brush head 142 and away from the attachment end 150 (FIG. 5). In the illustrated embodiment, the bristles 174 are secured to the bristle receptacles 170 by a staple. However, other mechanical connections to secure the bristles 174 to the bristle receptacles 170 are possible.

The lobes 162 of the brush head 142, as illustrated in FIG. 6, extend along a path P. The illustrated path P is curvilinear in shape. However, in other embodiments, the path P may be straight (i.e., linear). The curvilinear path P extends through the central portion 158. At least one of the lobes 162 varies in width along the curvilinear path P (the width being perpendicular to the curvilinear path and measured along a plane perpendicular to the axis A1). In the illustrated embodiment, the curvilinear path P extends between the central portion 158 and the distal points 166. The illustrated embodiment includes a base width W1, a tip width W3, and an intermediate width W2 measured approximately halfway between the base width W1 and the tip width W2 along the curvilinear path P. The intermediate width W2 is different than the base width W1 and is also different than the tip width W3. In the illustrated embodiment, the intermediate width W2 of the lobe 162 is larger than widths W1, W3 at the radially inner and outer ends of the lobe 162. In some embodiments, the base width W1 of the lobe 162 at an inner end (e.g., adjacent the central portion 158) is approximately 38% of the diameter D2 of the central portion 158. In other embodiments, the base width W1 of the lobe 162 may be between 25% and 50% of the diameter D2 of the central portion 158. In some embodiments, the intermediate width W2 of the lobe 162 at an intermediate portion between the central portion 158 and the distal point 166 is approximately 58% of the diameter D2 of the central portion 158. In other embodiments, the intermediate width W2 of the lobe 162 may be between 45 and 70% of the dimeter D2 of the central portion 158. In some embodiments, the width W3 of the lobe 162 adjacent the distal point 166 is approximately 25% of the diameter D2 of the central portion 158. In other embodiments, the tip width W3 of the lobe 162 may be between 0% and 50% of the diameter D2 of the central portion 158. In some embodiments, the width W2 is approximately 53% larger than the width W1 and approximately 129% larger than the width W3. In other embodiments, the width W2 may be between 40% and 60% larger than the width W1. In other embodiments, the width W2 may be greater than 100% or greater than 200% larger than the width W3.

The relative widths W1-W3 of the brush head 142 are exemplary and discussed herein for purposes of explanation. The relative widths W1-W3 may vary in width from the discussed widths W1-W3, and the lobes 162 may have other widths W1-W3 at the indicated sections and/or at locations between the indicated sections of the lobes 162.

Figure 10:
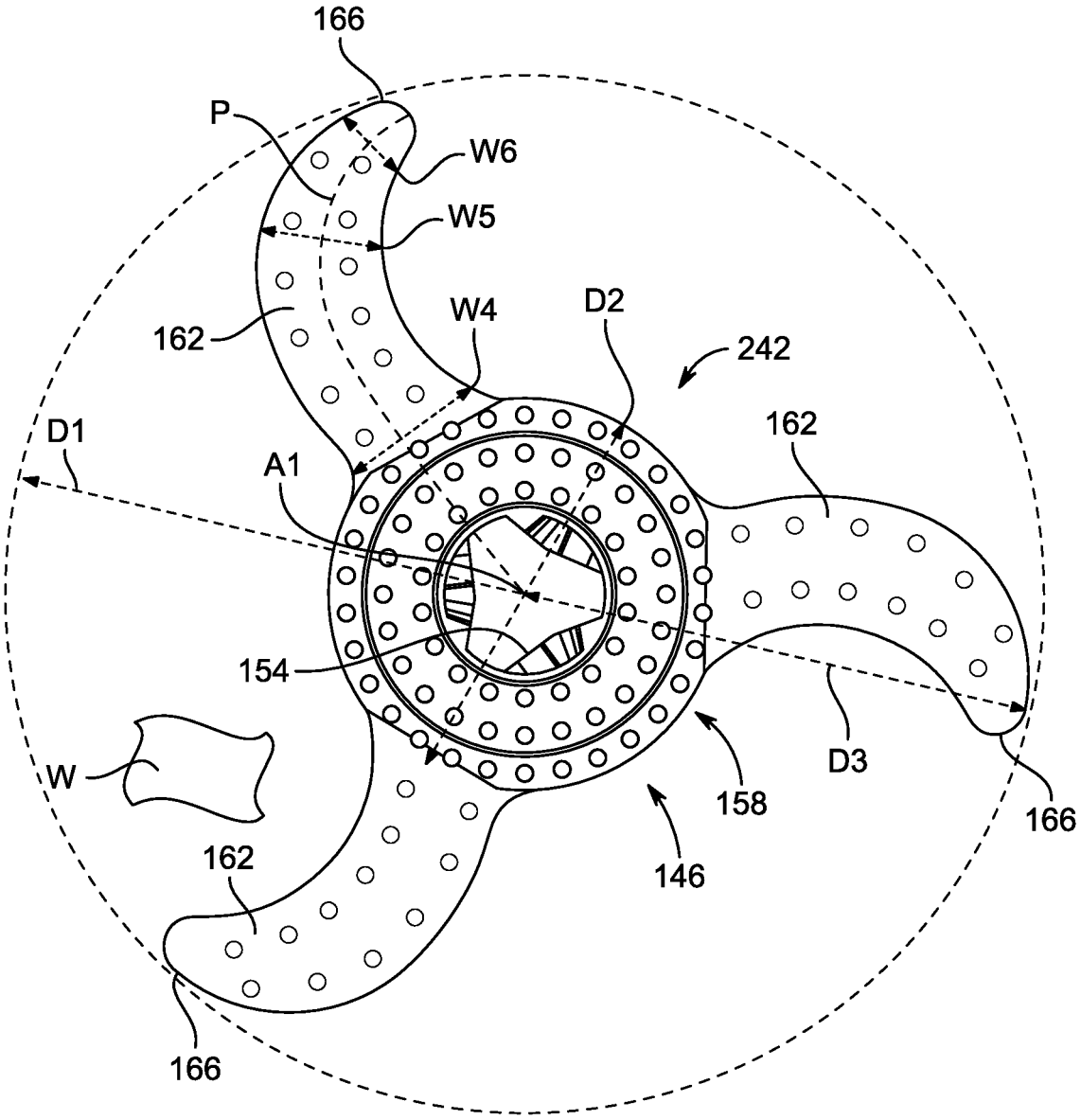
FIG. 10 is an end view of a work end of the brush head of FIG. 7.

FIGS. 7-10 illustrated a brush head 242 according to another embodiment. The brush head 242 includes similar features as the brush head 142, although the lobes of the brush head 242 have a different profile compared to the lobes 162 of the brush head 142. For example, the lobes 162 of the brush head 242 have a width that decreases from a radially inner end (e.g., adjacent the central portion 158) to a radially outer end (e.g., at the distal point 166). The lobes 162 of the brush head 242, as illustrated in FIG. 10, vary in width along the curvilinear path extending between the central portion 158 and the distal points 166. A width W4 taken adjacent the central portion 158 and spanning the width of the lobe 162 of the brush head 142 is approximately 38% of the diameter D2 of the central portion 158. In other embodiments, the width W4 may be between 30% and 50% of the diameter D2 of the central portion 158. A width W5 taken between the central portion 158 and the distal point 166 and generally perpendicular to the axis A1 is approximately 33% of the diameter D2 of the central portion 158. In other embodiments, the width W5 may be between 20% and 40% of the diameter D2 of the central portion 158. Finally, in the illustrated embodiment a width W6 taken adjacent the distal point 166 and generally transverse from the rotation axis A1 is approximately 19% of the diameter D2 of the central portion 158. In other embodiments, the width W6 may be between 0% and 40% of the diameter D2 of the central portion 158. In other words, the width W5 at the center of the lobe 162 is smaller than the width W4 at the end of the lobe 162 adjacent the central portion 158. Further, the width W6 at the end of the lobe 162 adjacent the distal points 166 is smaller than the width W4 at the end of the lobe 162 adjacent the central portion 158. In the illustrated embodiments, the width W5 is approximately 15% smaller than the width W4 and approximately 74% larger than the width W6. The width W5 may be between 1% and 35% smaller than the width W4. The width may be between 55% and 85% larger than the width W6. In the illustrated embodiment, the width W6 is approximately 50% smaller than the width W4. The width W6 may be between 25% and 75% smaller than the width W4.

The discussed widths W4-W6 of the brush head 242 are exemplary and discussed herein for purposes of explanation. The widths W4-W6 may vary in width from the discussed widths W4-W6, and the lobes 162 may have other widths W4-W6 at the indicated sections and/or at locations between the indicated sections of the lobes 162.

Figure 11:
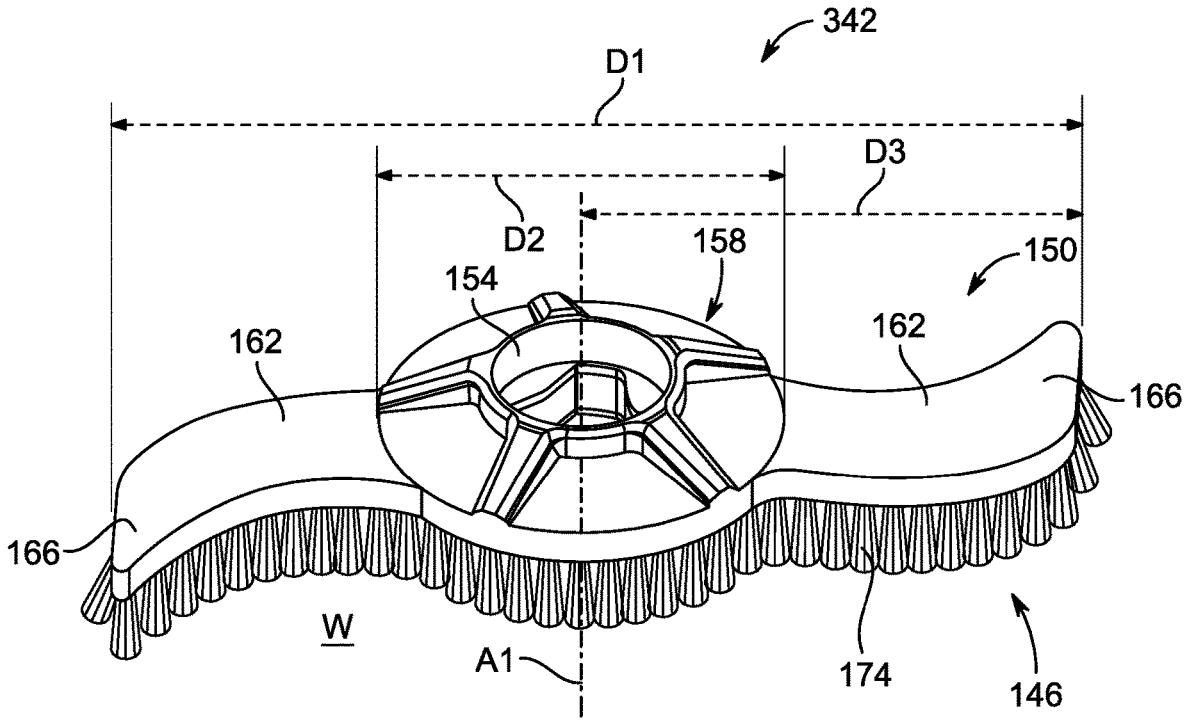
FIG. 11 is a perspective view of a brush head according to another embodiment.

FIG. 11 illustrates another brush head 342. The brush head 342 includes similar aspects to the brush head 142. However, the brush head 342 includes two lobes 162.

Figure 12:
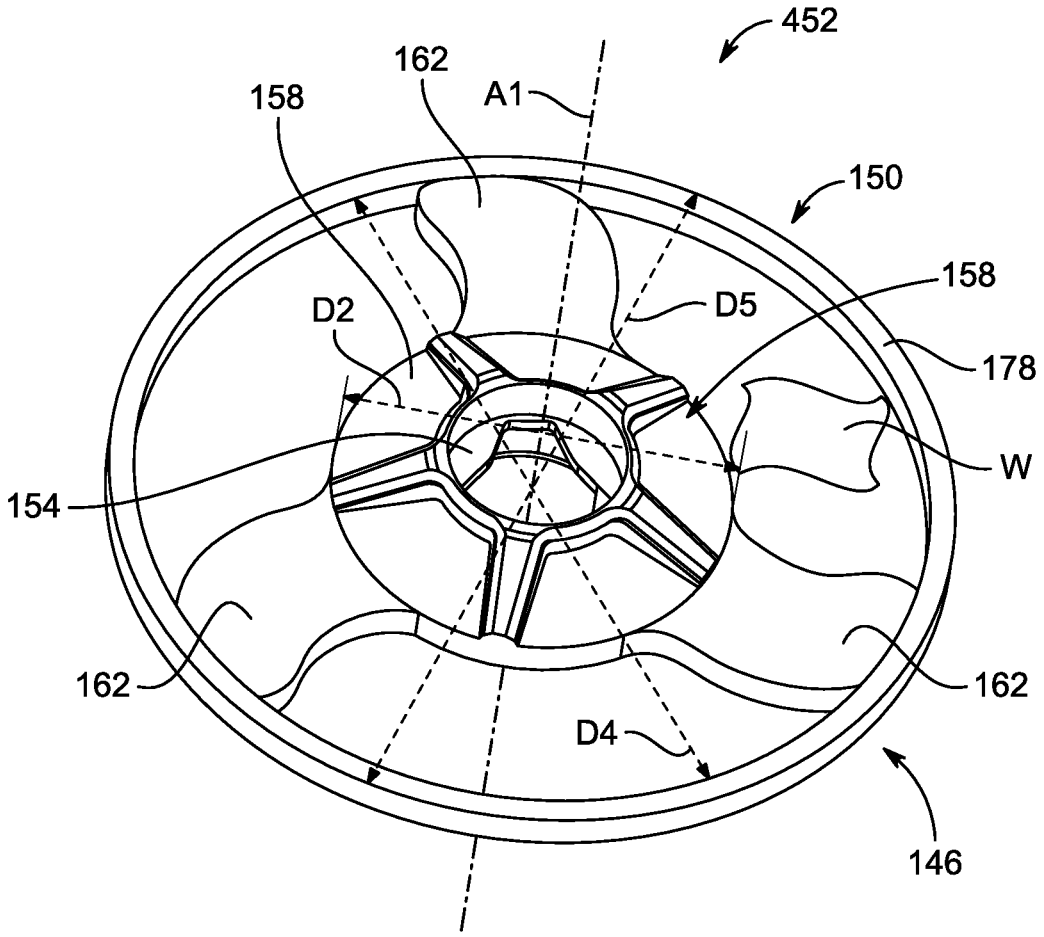
FIG. 12 is a perspective view of a brush head according to another embodiment.

FIG. 12 illustrates another brush head 442. The brush head 442 includes similar aspects to the brush head 242. For example, the widths W4-W6 of the brush head 242 are reflected in the brush head 442. However, the brush head 442 further includes an outer ring 178 located adjacent the distal points 166 of each lobe 162. The outer ring 178 is secured to each of the lobes 162 to provide structural integrity to the brush head 442. In some embodiments, the outer ring 178 is molded as an integral piece with the lobes 162 and the central portion 158. The outer ring 178 provides adequate rigidity to the brush head 442 to withstand scrubbing forces while permitting a user of the scrubber 10 to view the work surface between the outer ring 178, the central portion 158 and each of the lobes 162. The outer ring 178 may further include bristle receptacles 170 housing bristles 174 which protrude from work end 146 and away from the opposite attachment end 150.

Figure 13:
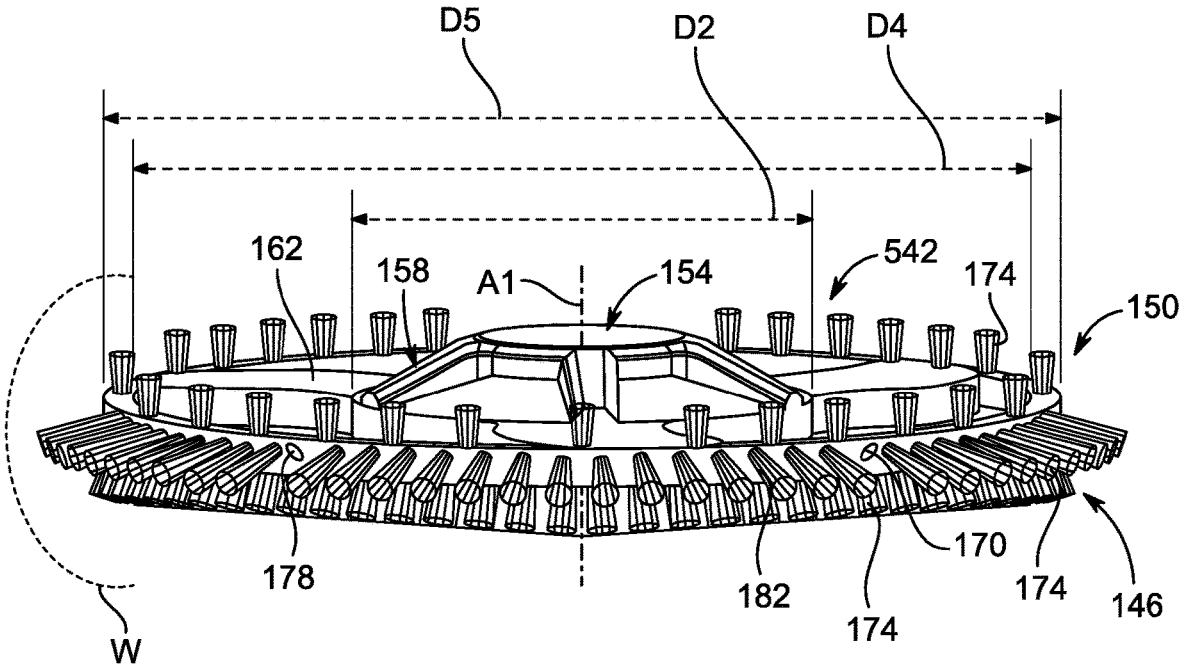
FIG. 13 is a perspective view of a brush head according to another embodiment.

FIG. 13 illustrates another brush head 542. The brush head 542 includes similar aspects to the brush head 442. For example, the brush head 542 includes the outer ring 178. The outer ring 178 of the brush head 542 may further include bristle receptacles 170 housing bristles 174 which protrude from the attachment end 150 and away from the work end 146. Further, the outer ring 178 of the brush head 542 may further include bristle receptacles 170 housing bristles 174 which protrude from a radially outer surface 182 (e.g., curved radially outer surface) of the outer ring 178 such that the bristles 174 protrude radially outwardly and away from the rotation axis A1, the radially outer surface 182 also facing radially away from the rotation axis A1. Such a brush head 542 is operable to scrub work surfaces W as illustrated in FIG. 13 having curved surfaces.

FIG. 13 illustrates a relative size of the central portion 158 in comparison with the outer ring 178. The central portion 158 has an outer diameter D2, the outer ring 178 has an inner diameter D4, and the outer ring 178 has an outer diameter D5. The inner diameter D4 is larger than the outer diameter D2 of the central portion 158. The outer diameter D5 is larger than the inner diameter D4. In the illustrated embodiment, the inner diameter D4 is approximately 94% larger than the outer diameter D2. In other embodiments, the inner diameter D4 may be between 50% and 200% larger than the outer diameter D2. In the illustrated embodiment, the outer diameter D5 is approximately 7.2% larger than the inner diameter D4. In other embodiments, the outer diameter D5 may be between 1% and 25% larger than the inner diameter D4.

Due to the above-described sizes of the diameters D2, D4, D5, and the spacing of the lobes 162 about the rotation axis A1, the outer ring 178 is spaced radially from the central portion 158 such that a user may view a workpiece W acted upon by the brush head 142.

Figure 14:
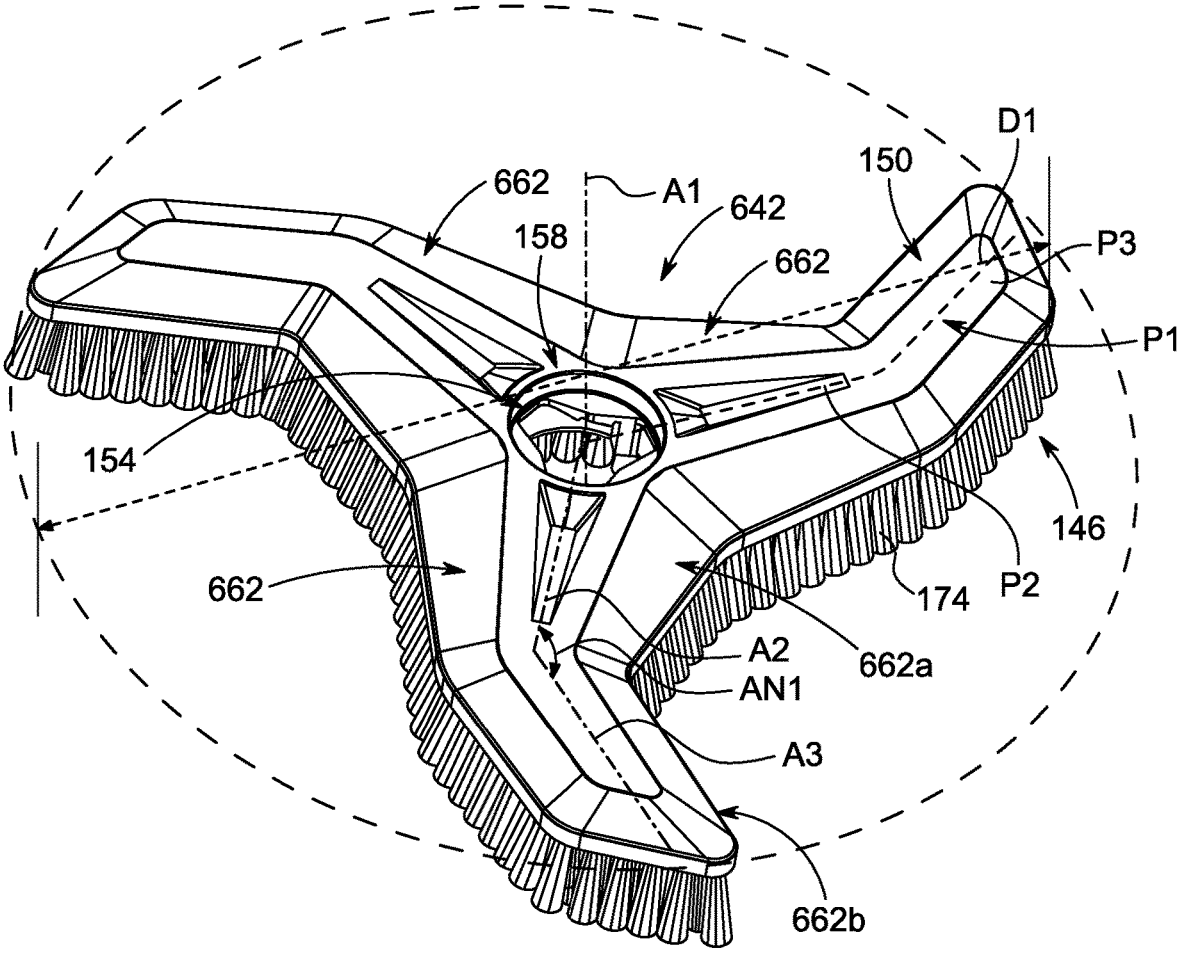
FIG. 14 is a perspective view of a brush head according to another embodiment.

FIG. 14 illustrates another brush head 642. The brush head 642 includes a plurality of lobes 662 extending radially outwardly from the rotation axis A1. Each lobe 662 includes a proximal potion 662*a* adjacent the central portion 158 and a distal portion 662*b* coupled to the proximal portion 662*a* at a distance from the central portion 158. The lobes 662 each extend along a rectilinear profile P1. The rectilinear profile P1 includes an inner segment P2 and an outer segment P3. The proximal portion 662*a* extends along the inner segment P2 and the distal portion 662*b* extends along the outer segment P3. The inner segment P2 extends along an inner segment axis A2, and the outer segment P3 extends along an outer segment axis A3. In the illustrated embodiment, the inner segment axis A2 intersects the rotation axis A1. However, in other embodiments, the inner segment axis A2 may be offset from the rotation axis A1. The outer segment axis A3 is angled relative to the inner segment axis A2 at an angle AN1. In the illustrated embodiment, the angle AN1 is approximately 120 degrees. In other embodiments, the angle AN1 may be between approximately 100 degrees and approximately 140 degrees.

Figure 15:
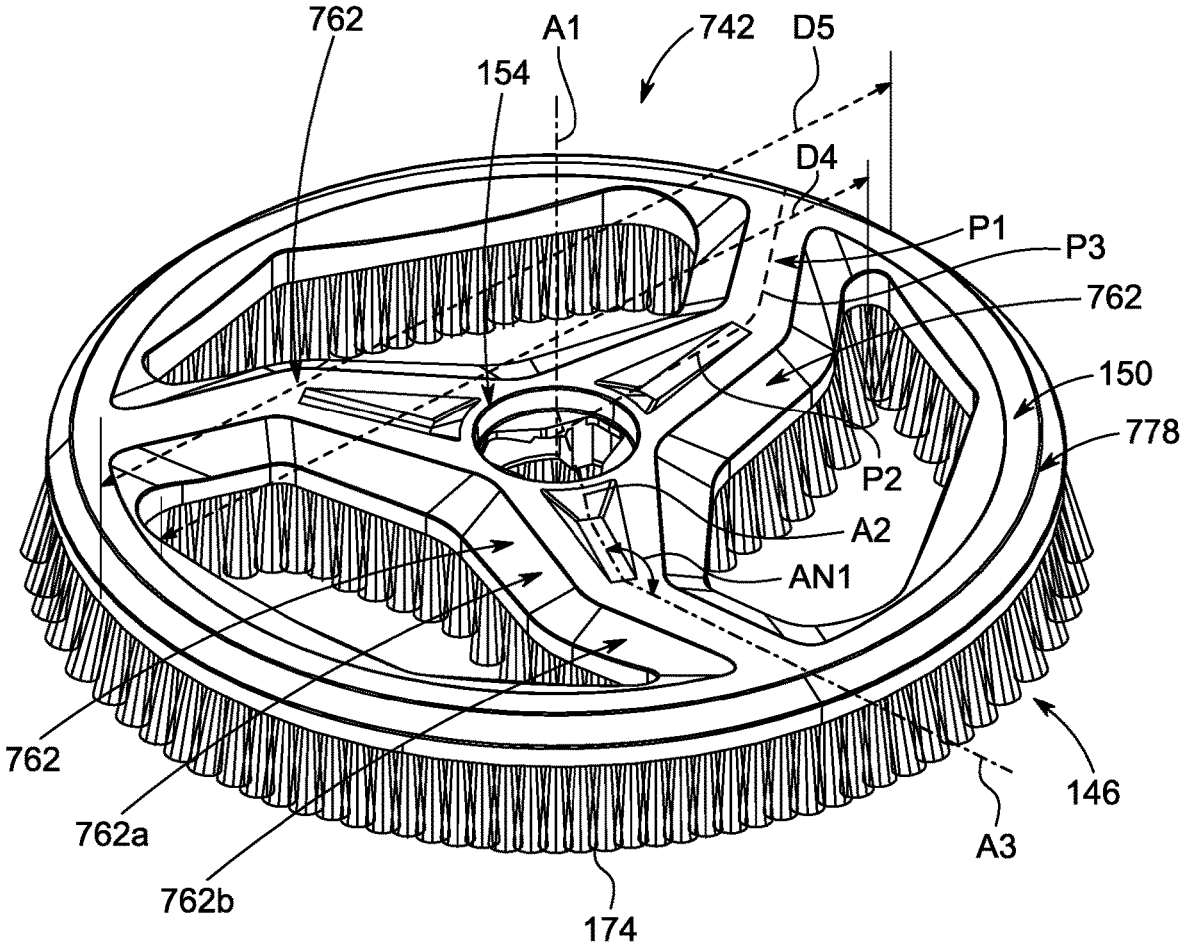
FIG. 15 is a perspective view of a brush head according to another embodiment.

FIG. 15 illustrates another brush head 742. The brush head 742 includes a plurality of lobes 762 having dimensions similar to the brush head 642. The brush head 742 further includes an outer ring 778 with similar dimensions compared to the outer ring 178 of the brush head 542.

Figure 16A:
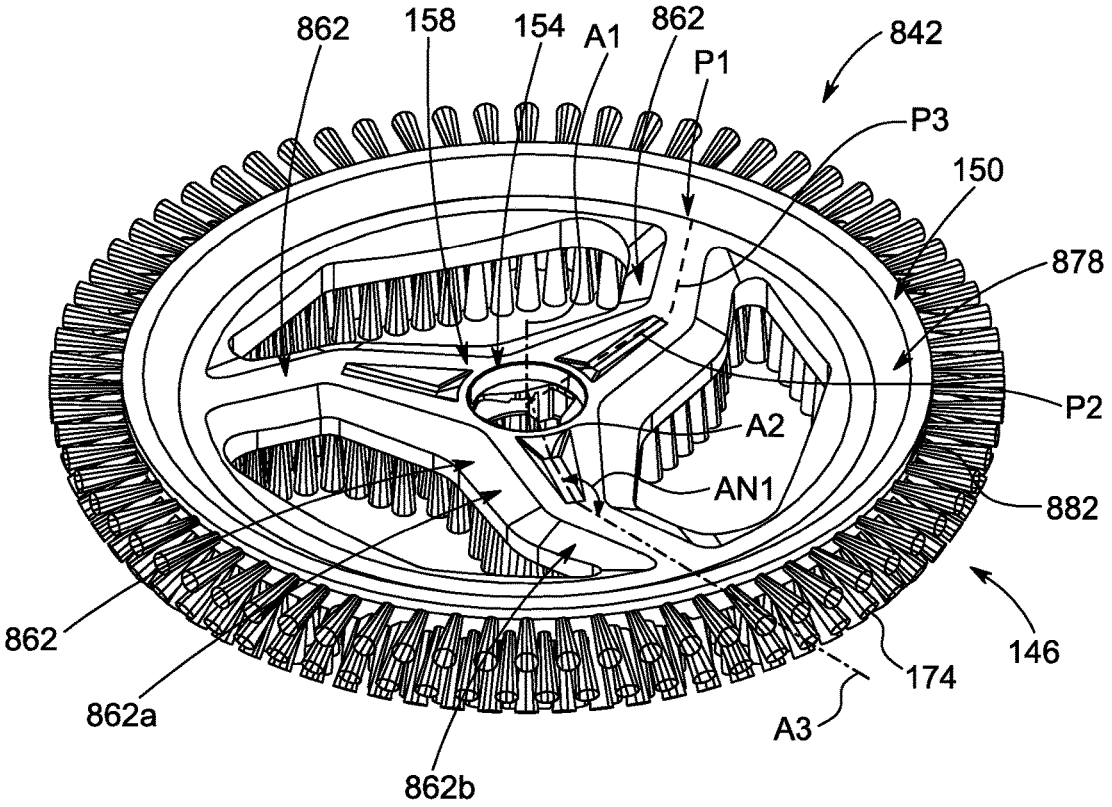
FIG. 16A is a perspective view of a brush head according to another embodiment.
Figure 16B:
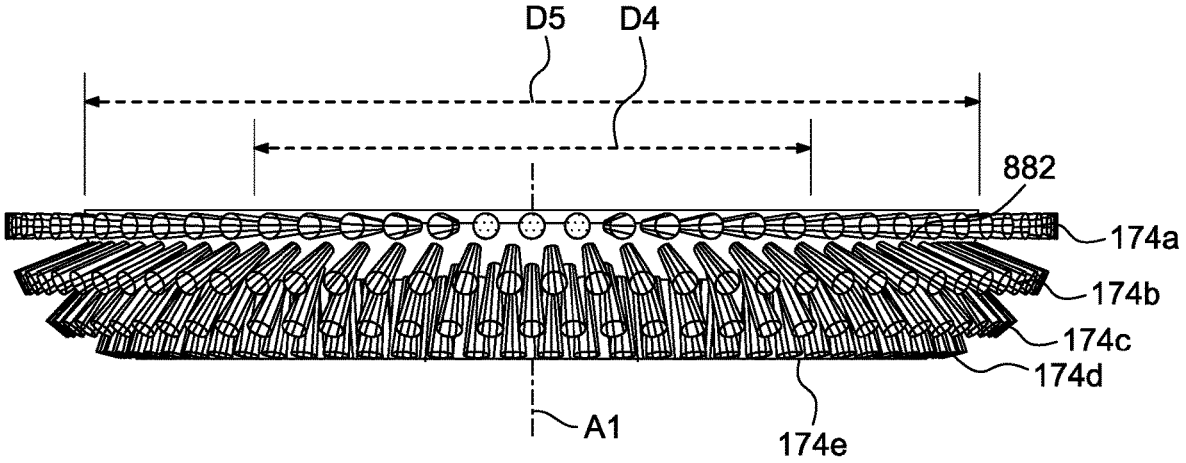
FIG. 16B is a side view of the brush head in accordance with the embodiment of FIG. 16A.
Figure 16C:
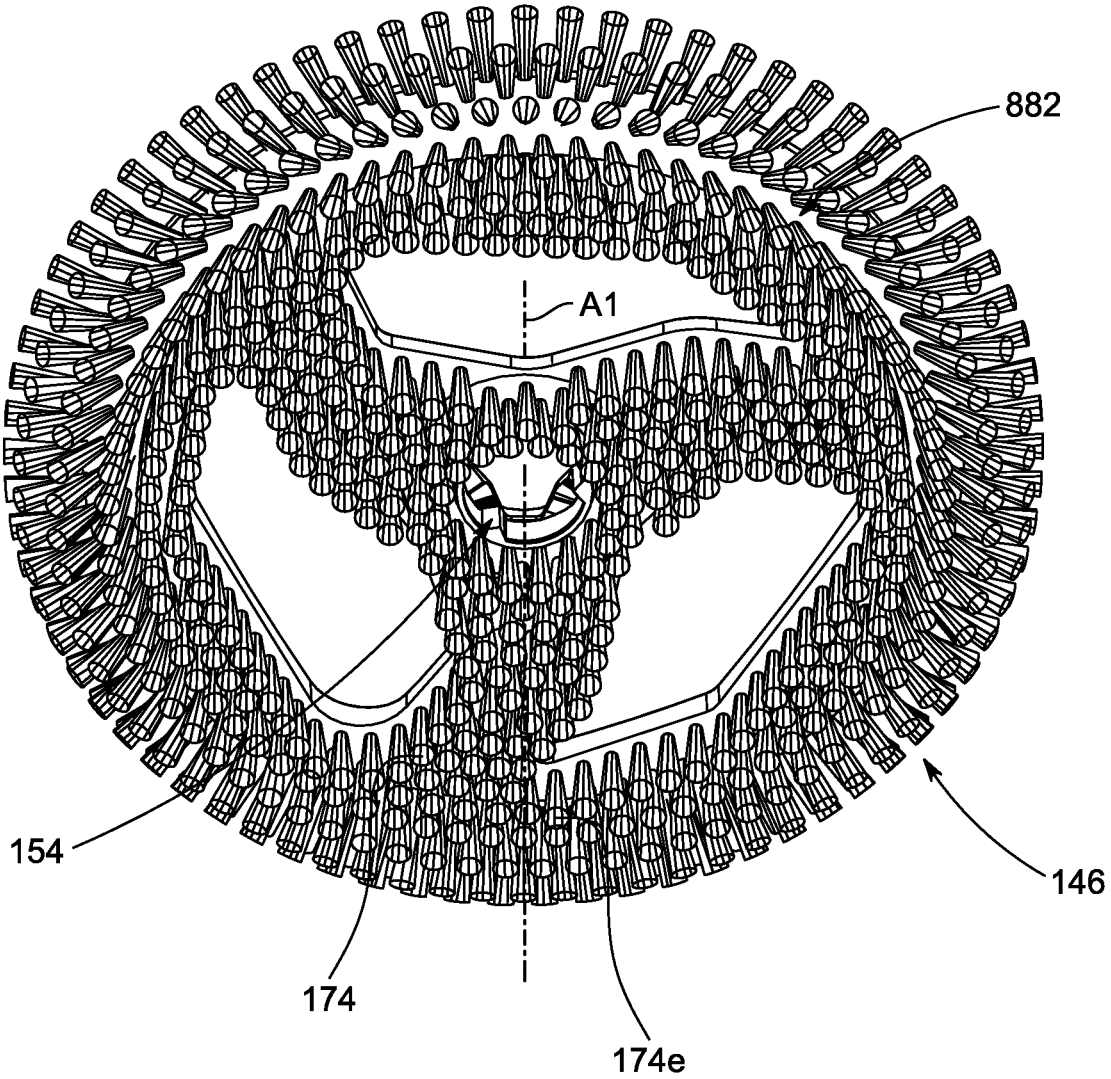
FIG. 16C is another perspective view of the brush head in accordance with the embodiment of FIG. 16A.

FIGS. 16A-16C illustrate another brush head 842. As illustrated in FIG. 16A, the brush head 842 includes a plurality of lobes 862 having dimensions similar to the brush head 642 and the brush head 742. The brush head 842 further includes an outer ring 878 having dimensions similar to the outer rings 178, 778 of the brush heads 542, 742.

FIG. 16B shows a side view of the brush head 842. The outer ring 878 thereof includes a curved outer surface 882. A plurality of bristles 174 are coupled to the outer ring 878.

The bristles 174 include five sets of bristles 174*a*-174*e* thereof which each extend in differing directions with a corresponding angle (e.g., 0, 30, 45, 60, or 90 degrees, or less than 90 degrees relative to the rotation axis A1). Other embodiments may include few or more sets of bristles 174 (e.g., four, six, etc.) and may include bristles extending at different angles than that shown.

Figure 17A:
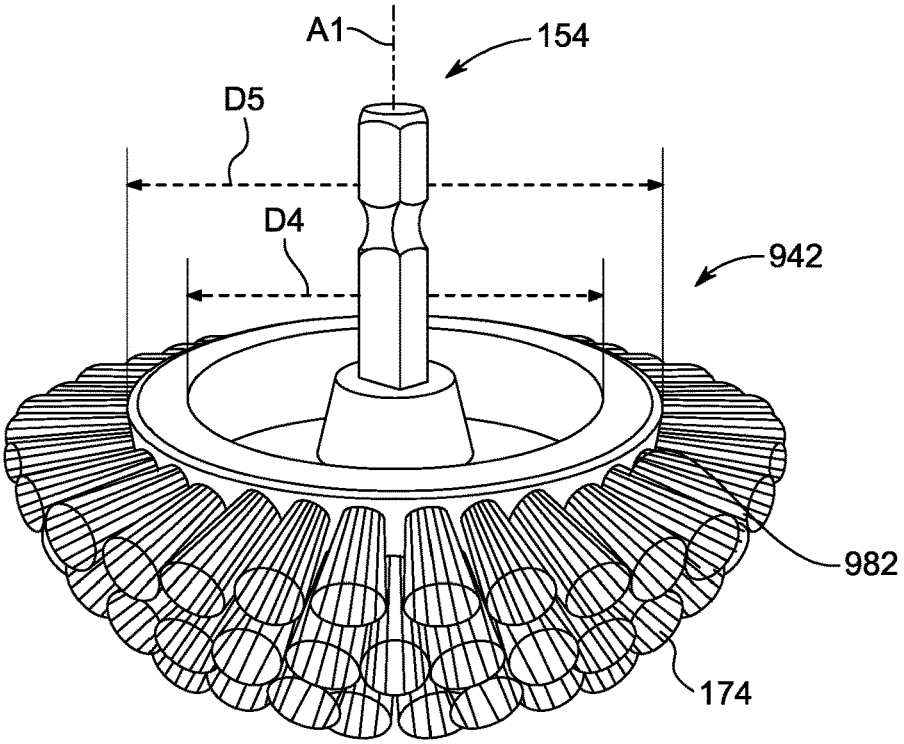
FIG. 17A is a perspective view of a brush head according to another embodiment.
Figure 17B:
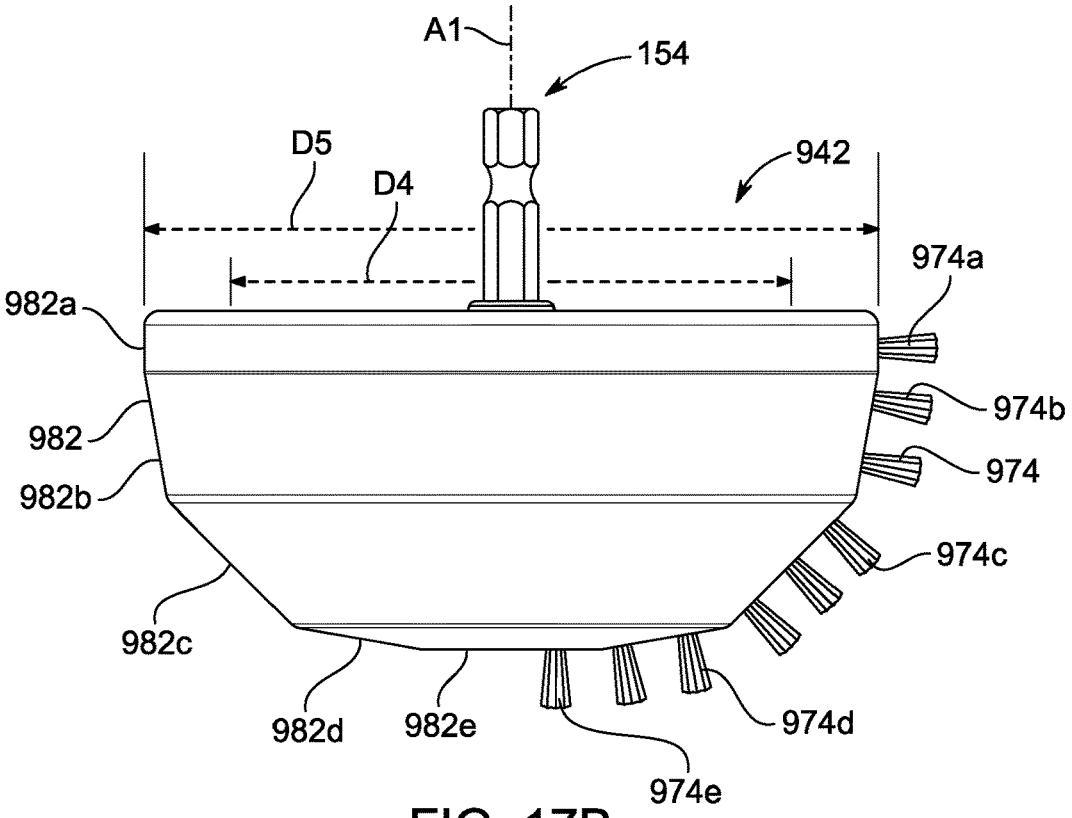
FIG. 17B is a sideview of the brush head of FIG. 17A having some of the bristles thereof removed.

FIGS. 17A and 17B illustrate another brush head 942 having an outer surface 982. The outer surface 982 of the brush head 942 may be generally hemispherical (i.e., similar to a dome) in geometry. As best shown in FIG. 17B, in some embodiments the outer surface 982 has a generally rectilinear profile comprising five segments 982*a*-982*e*. While each of the five segments 982*a*-982*e* are each planar, the outer surface 982 as a whole is generally hemispherical. The first segment 982*a* of the outer surface 982 is annular in shape, and is parallel with the rotation axis A1. The fifth segment 982*e* of the outer surface 982 is circular in shape, and extends perpendicularly to the rotation axis A1. The remaining segments (i.e., the second segment 982*b*, the third segment 982*c*, and the fourth segment 982*d*) are tapered about the axis A1, and are angled relative to the rotation axis A1. The segments 982*a*-982*e* are angled about the rotation axis A1 in a progressive manner such that a segment (e.g., segment 982*c*) positioned adjacent another preceding segment (982*b*) closer to the first segment 982*a* is angled at a different and greater angle than the preceding segment relative to the rotation axis A1. Other arrangements are possible. Bristles 974 (e.g., similar to the bristles 174 described above) extend in a plurality of directions from the outer surface 982 and relative to the rotation axis A1. In the illustrated embodiment, some of the bristles 974 (i.e., a first subset 974*a* of the bristles 974) extend radially outwardly from (e.g., perpendicular relative to) the rotation axis A1. Another subset 974*e* of the bristles 974 extend parallel to the rotation axis A1. Other subsets 974*b*-974*d* of the bristles 974 extend in varying directions relative to the rotation axis A1 that are not parallel nor perpendicular thereto. In the illustrated embodiment, the segments 982*a*-982*e* of the outer surface 982 are progressively angled such that the brush head 942 is generally hemispherical (i.e., similar to a dome) in geometry. Each subset 974*a*-974*e* of bristles 974 is mounted to the corresponding segment 982*a*-982*e* of the outer surface 982.

Figure 18:
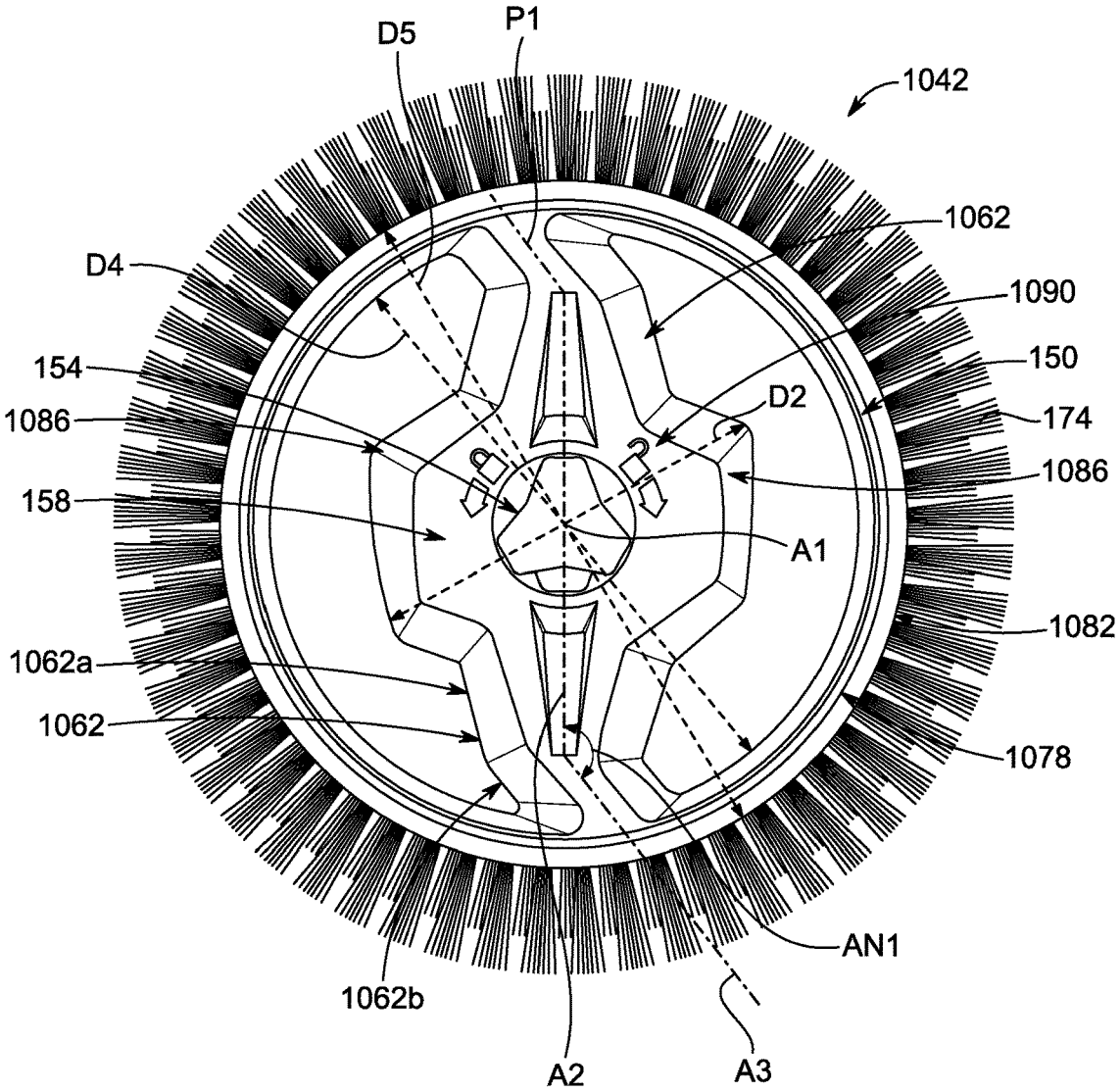
FIG. 18 is a perspective view of a brush head according to another embodiment.

FIG. 18 illustrates another brush head 1042 having two lobes 1062 like the lobes 862 of the brush head 842, and two shortened lobes 1086. The brush head 1042 includes other similar aspects when compared to the brush head 842. In the illustrated embodiment of FIG. 18, the lobes 1062 extend along rectilinear paths P1 opposing each other (i.e., spaced 180 degrees) about the rotation axis A1 from one another. Other configurations having two lobes 1062 at other differing angles (e.g., at 90, 60, 45, or 30 degrees) from one another are possible. In other embodiments, only a proximal portion 1062*a* of each of the lobes 1062 may oppose the other lobe about the rotation axis A1, while the distal portion 1062*b* may be otherwise angled relative to the proximal portion 1062*a* about a given angle AN1.

The illustrated shortened lobes 1086 of the brush head 1042 project outwardly from the central portion 158 of the brush head 1042. The illustrated shortened lobes 1086 have a different geometry when compared to the lobes 1062. The shortened lobes 1086 do not connect the central portion 158 to an outer ring 1078 of the brush head 1042. The shortened lobes 1086 generally define an expanded diameter D2 of the central portion 158 which remains less than the inner diameter D4 of the outer ring 1078. Bristles 174 (not shown) may be provided on the work end 146 of the shortened lobes 1086 and the lobes 1062. As seen in FIG. 18, bristles 174 may also, or alternatively, be provided on an outer surface 1082 of the outer ring 1078. These bristles 174 extend radially outwardly from the axis A1. Optionally, the outer ring 1078 may be provided with bristles 174 on the working end 146 thereof. In the illustrated embodiment, the attachment end 150 of the brush head 1042 is provided with indicia 1090 which illustrate to a user of the brush head 1042 which rotation direction about the rotation axis A1 the user should provide torque to secure (i.e., lock) or remove (i.e., unlock) the brush head 1042 from a working tool (e.g., the scrubbing end 14 of the scrubber 10).

Figure 19:
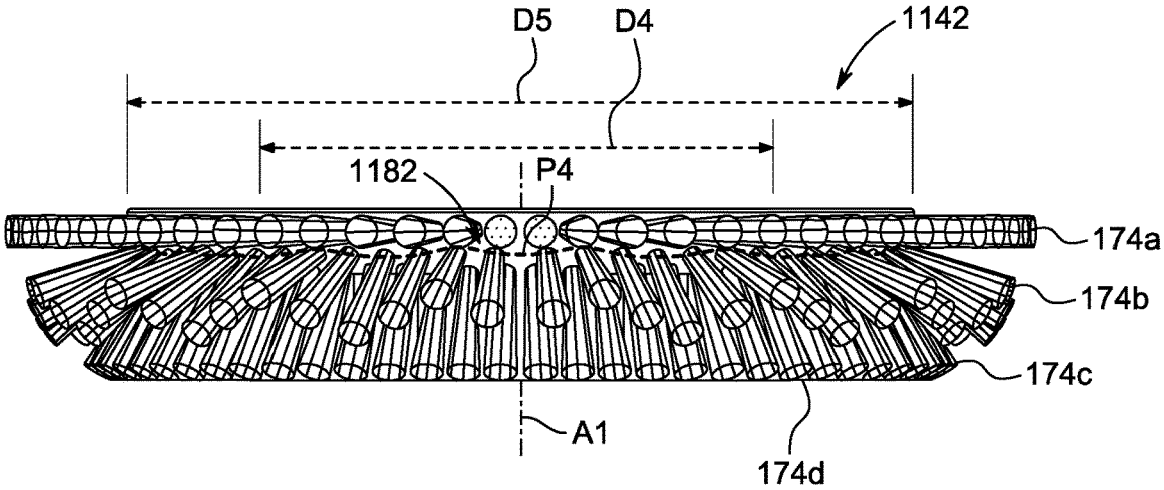
FIG. 19 is a side view of a brush head according to another embodiment.

FIG. 19 illustrates another brush head 1142 having an outer surface 1182 with a plurality of sets of bristles 174*a*-174*d* protruding therefrom. The bristles 174*a*-174*d* extend in differing directions with respect to the rotation axis A1. The bristles 174*a*-174*d* each extend in differing directions with a corresponding angle (e.g., 0, 30, 45, 60, or 90 degrees, or less than 90 degrees relative to the rotation axis A1). Other embodiments may include few or more sets of bristles 174 (e.g., four, six, etc.) and may include bristles extending at different angles than that shown. As illustrated in FIG. 19, the set of bristles 174*b* are mounted on the outer surface 1182 at varying heights along the rotation axis A1. One of the set of bristles 174*b* is mounted at a first angle (e.g., 45 degrees) relative to the rotation axis A1. Another of the set of bristles 174*b* is mounted at a second angle (e.g., 30 degrees) relative to the rotation axis A1 that is different than the first angle. In the illustrated embodiment, each of the bristles of the set of bristles 174*b* are coupled to the outer surface 1182 along a path P4. The path P4 is generally annular in shape and surrounds the rotation axis A1. In the illustrated embodiment, the path P4 is a regular wave. For example, the path P4 in the illustrated embodiment generally follows a sine wave. In other embodiments, the path P4 may be otherwise provided as a differing regular wave, a rectilinear wave, or the like. In other embodiments, more than one of the sets 174*a*-174*b* may follow the same or differing paths P4 about the rotation axis A1.

In many of the above-described embodiments for the brush head (i.e., the brush heads 142, 242, 342, 442, 542, 642, 742, 842, 1042, 1142), a user is capable of seeing the workpiece W which the brush head 142, 242, 342, 442, 542, 642, 742, 842, 1042, 1142 is configured to clean. The bristles 174, 974 of the illustrated brush heads 142, 242, 342, 442, 542, 642, 742, 842, 942, 1042, 1142 may for example be nylon bristles configured to be grouped together and received in the bristle receptacles 170. At least one or more of the bristles 174, 974 of each brush head 142, 242, 342, 442, 542, 642, 742, 842, 942, 1042, 1142 may be replaced by a rubber, foam, microfiber or other material. For example, the bristles 174 as shown in FIG. 13 positioned on the radially outer surface 182 may be replaced by rubber, foam, microfiber, or other material.

The above-described and illustrated embodiments for the brush head (i.e., the brush heads 142, 242, 342, 442, 542, 642, 742, 842, 942, 1042, 1142) each represent illustrative brush heads 142, 242, 342, 442, 542, 642, 742, 842, 942, 1042, 1142. The exact dimensions of the brush heads 142, 242, 342, 442, 542, 642, 742, 842, 942, 1042, 1142, the bristles 174, 974, and the like may differ from the illustrated brush heads 142, 242, 342, 442, 542, 642, 742, 842, 942, 1042, 1142. For example, the effective diameter D1 (and/or the outer diameter D5) may be as small as, for example 2 inches, and as large as, for example, 20 inches. The illustrated brush heads 142, 242, 342, 442, 542, 642, 742, 842,

942, 1042, 1142 may be sized with an effective diameter D1 (and/or the outer diameter D5) of between 3 inches, and 12 inches. For example, the illustrated brush head 942 has an outer diameter D5 of approximately 3.5 inches. The illustrated brush head 142 may be sized with an effective diameter D1 of approximately 12 inches. Other sizes of the effective diameter D1 (and/or the outer diameter D5) are possible. Similarly, the densities (e.g., brush fiber densities), thicknesses/diameters, and/or lengths of each of the bristles 174, 974 may vary, and may differ for example from the illustrated versions of the bristles 174, 974. For example, the lengths of the bristles 174, 974 may range for example between 0.1 inch and 1.5 inch, or between 0.5 inch and 1.0 inch. The thicknesses and/or diameters of the bristles 174 may range for example between 0.1 inch and 0.5 inch, or between 0.2 inch and 0.4 inch.

Although aspects of the disclosure have been described in detail with reference to certain preferred embodiments, variations and modifications exist within the scope and spirit of one or more independent aspects as described. One or more independent features and/or advantages of the invention may be set forth in the following claims.

What is claimed is:

1. A brush head comprising:

a central portion, an attachment feature configured to secure the brush head for rotation about a rotation axis, and a plurality of lobes extending radially outwardly from the central portion, at least one of the plurality of lobes extending along a rectilinear path, the rectilinear path having an inner segment and an outer segment, wherein the outer segment is located radially outwardly from the inner segment, the outer segment being angled relative to the inner segment by a non-zero angle measured in a plane perpendicular to the rotation axis, the at least one of the plurality of lobes having a proximal portion extending along the inner segment and a distal portion extending along the outer segment, the proximal portion defining an inner non-curved outer edge along one side of the at least one of the plurality of lobes, and the distal portion defining an outer non-curved outer edge along the one side of the at least one of the plurality of lobes;

an outer ring extending circumferentially about the plurality of lobes and located radially outwardly from the plurality of lobes, with the distal portion of the at least one of the plurality of lobes coupled to the outer ring and the proximal portion located radially inwardly of the outer ring relative to the rotation axis;

a first set of bristles coupled to the outer ring, the first set of bristles extending radially away from the outer ring and the rotation axis; and a second set of bristles coupled to the outer ring, the second set of bristles extending away from outer ring and the rotation axis;

wherein the second set of bristles form a wave pattern extending circumferentially around the outer ring, such that a distal end of one of the bristles in the second set of bristles is spaced axially away from a distal end of another one of the bristles in the second set of bristles.

2. The brush head of claim 1, further comprising a first bristle coupled to the proximal portion and a second bristle coupled to the distal portion.

3. The brush head of claim 1, wherein each of the first set of bristles extends away from the rotation axis with a first angle relative to the rotation axis, the first angle being approximately 90 degrees, wherein each of the second set of bristles extends in a direction away from the rotation axis and with a second angle relative to the rotation axis, the second angle being less than 90 degrees.

4. The brush head of claim 3, further comprising a third plurality of bristles provided on the outer ring, the third plurality of bristles extending in a direction away from the rotation axis and with a third angle relative to the rotation axis, the third angle being less than the second angle.

5. The brush head of claim 1, wherein the plurality of lobes includes three lobes.

6. The brush head of claim 1, wherein the plurality of lobes are circumferentially evenly spaced about the rotation axis.

7. The brush head of claim 6, wherein the inner segment and the outer segment of each of the plurality of lobes are angled relative to one another about a same circumferential direction about the rotation axis.

8. The brush head of claim 1, wherein the non-zero angle between the outer segment and the inner segment is equal to or greater than 100 degrees and equal to or lesser than 140 degrees.

9. The brush head of claim 1, wherein the proximal portion of at least one lobe of the plurality of lobes is oriented perpendicular to the rotation axis.

10. The brush head of claim 1, wherein the proximal portion of each of the lobes of the plurality of lobes is oriented perpendicular to the rotation axis.

11. The brush head of claim 1, wherein the brush head has an outer surface that is hemispherical in shape.

12. The brush head of claim 1, wherein the attachment feature includes a ramp configured to engage a scrubber head.

13. The brush head of claim 1, wherein the angle of the inner segment relative to the outer segment is a non-zero angle that is less than 180 degrees.

14. The brush head of claim 3, wherein the wave pattern is a sine wave pattern.

15. The brush head of claim 1, wherein the rectilinear path extends through the central portion.

16. The brush head of claim 1, wherein the central portion is centered about the rotation axis, and the plurality of lobes extend radially outwardly from the central portion and the rotation axis.

17. The brush head of claim 1, wherein the central portion, the plurality of lobes, and the outer ring together define a plurality of openings located radially inwardly from the outer ring, wherein the plurality of openings define circumferential gaps between portions of the plurality of lobes.

18. The brush head of claim 1, further comprising a plurality of lobe bristles coupled to the plurality of lobes and a plurality of outer ring bristles coupled to the outer ring, wherein the plurality of lobe bristles and the plurality of outer ring bristles each extend parallel to the rotation axis.

* * * * *